US005433132A

United States Patent [19]

Hufault

[11] Patent Number: 5,433,132

[45] Date of Patent: Jul. 18, 1995

[54] ELECTROMAGNETIC RADIATION RESISTANT MISSILE LAUNCHING SYSTEM

[75] Inventor: John R. Hufault, Tucson, Ariz.

[73] Assignee: Hughes Missile Systems Company, Los Angeles, Calif.

[21] Appl. No.: 239,825

[22] Filed: May 9, 1994

[51] Int. Cl.[6] ..... F41F 3/04

[52] U.S. Cl. ..... 89/1.812; 89/1.816

[58] Field of Search ..... 89/1.816, 1.817, 1.814, 89/1.812, 1.8

[56] References Cited

U.S. PATENT DOCUMENTS

| | | | |
|---|---|---|---|
| 4,357,855 | 11/1982 | Merz | 89/1.816 |
| 4,429,611 | 2/1984 | Oldham et al. | 89/1.8 |
| 4,455,916 | 6/1984 | Whittaker | 89/1.812 |
| 4,498,368 | 2/1985 | Doane | 89/1.817 |
| 5,175,600 | 12/1992 | Frank et al. | 89/1.816 |

*Primary Examiner*—David Brown
*Attorney, Agent, or Firm*—Charles D. Brown; Randall M. Heald; Wanda K. Denson-Low

[57] ABSTRACT

A missile and launcher system that shields a missile from external electromagnetic radiation. Shielding is accomplished by separating the shielding system of the missile from the shielding system of its launcher system. Unique and separate shielding of the missile is accomplished by utilizing the missile launching enclosure. External signal isolation is accomplished by providing insulation on the interface cable between the missile and the launcher system to attenuate high frequency electromagnetic radiation signals. The present invention is implemented using an unconventional combination of technologies that includes the use of composite materials, vapor deposited conductive coatings, high frequency dielectric insulation filtering, and high frequency coupling of the radiation on the surface of the enclosure and the launcher system. The launcher system comprises a conductive launcher frame, a missile case for carrying the missile therein that comprises a launch tube having a conductive coating disposed thereon, and a plurality of conductive composite trunnion preforms molded into the launch tube. Forward and aft conductive composite preforms are molded into the launch tube adjacent opposite ends thereof. Removable forward and aft conductive end caps are removably coupled to opposite ends of the launch tube and are capacitively coupled thereto by means of the forward and aft preforms. A conductive coated flexible holdback seal and seal retainer is disposed on the launch tube. An umbilical connector is affixed to the launch tube and is retained with the flexible holdback seal and seal retainer. A raceway and an umbilical cable harness are coupled between the umbilical connector and the missile. The umbilical cable harness comprises dielectric filter line wire that attenuates high frequency electromagnetic radiation and isolates the radiation from the missile.

7 Claims, 2 Drawing Sheets

ELECTROMAGNETIC RADIATION RESISTANT MISSILE LAUNCHING SYSTEM

BACKGROUND

The present invention relates to missiles, and more particularly, to an electromagnetic radiation resistant missile and launcher system for shielding a missile from external electromagnetic radiation.

It is very desirable to provide for protection of a guided missile that is potentially exposed to electromagnetic radiation while it is in a hazardous electromagnetic radiation to ordnance environment. Placing the missile in such an environment can cause the missile to be degraded, damaged, or prematurely detonated when stored, handled, transported, or deployed.

Conventional electromagnetic radiation resistant enclosures for missiles employ shielding that provides for direct contact (low ohmic resistance) Faraday shielding of the missile. The conventional enclosure employs fully shielded connector hardware and precise sealing of all joints and mechanical interfaces on the missile. The disadvantage to this approach is its high cost and reduced reliability when the missile is subjected to shock and vibration environments.

In conventional shielded missiles, the shielding of the missile launcher system is integrated into the missile system shielding through the precisely sealed mechanical interfaces and shielded interface connectors. This approach is technically difficult and expensive, particularly if it is desired to upgrade an existing missile system that was not originally built with integrated shielding.

Therefore, it is an objective of the present invention to provide for an electromagnetic radiation resistant missile and launcher system. It is a further objective of the present invention to provide for a housing for a missile and launcher system that provides for decoupling, or isolation, of high frequencies in interface wiring between the missile and the launcher, while at the same time using the missile housing or case to form an independent high frequency Faraday shield around the missile.

SUMMARY OF THE INVENTION

In order to meet the above and other objectives, the present invention provides a new approach for shielding a missile and launcher system from external electromagnetic radiation. Shielding is accomplished by separating the missile shielding system from the launcher shielding system. Unique and separate shielding of the missile is accomplished by utilizing the missile launching enclosure (housing or case). External signal isolation is accomplished by providing special insulation on the interface cable between the missile and the launcher system to attenuate high frequency electromagnetic radiation signals. The present invention is implemented using an unconventional combination of technologies that includes the use of composite materials, vapor deposition techniques, high frequency dielectric insulation filtering techniques, and strategic high frequency coupling techniques.

More specifically, the present invention comprises an electromagnetic radiation resistant missile and launcher system for shielding a missile from incident electromagnetic radiation. The system (10) comprises a missile, guidance electronics having a shielded electrical cable for coupling signals to the missile to control guidance and launching thereof, and a launch system.

The launch system comprises a conductive launcher frame having a plurality of structures that support it when it is on ground or attached to a vehicle, such as a helicopter, for example. A missile case is provided for carrying the missile therein that comprises a launch tube having a conductive coating disposed on the outer surface thereof, and a plurality of trunnion preforms molded into the launch tube that comprise conductive composite material and that are supported by the launcher frame to support it when it is on the ground. Forward and aft preforms are molded into the launch tube adjacent opposite ends thereof that comprise conductive composite material. Removable forward and aft conductive end caps are removably couplable to opposite ends of the launch tube and are capacitively coupled to the launch tube by means of the forward and aft preforms.

A flexible holdback seal and seal retainer is disposed on an external surface of the launch tube that have a conductive coating disposed thereon. The conductive coating on the flexible holdback seal and seal retainer may comprise a low temperature vapor deposited conductive coating, for example. An umbilical connector is disposed on the external surface of the launch tube that electrically and mechanically connects to the launcher cable.

A raceway is disposed between the umbilical connector and the missile, and an umbilical cable harness is disposed in the raceway and coupled between the umbilical connector and the missile that comprises dielectric filter line wire for attenuating high frequency electromagnetic radiation and isolate the high frequency electromagnetic radiation from the missile.

A Faraday shield is formed by the conductive coatings disposed on the end caps, the flexible holdback seal and seal retainer, and the launch tube, the umbilical connector, the forward and aft preforms. The trunnion preforms couple the electromagnetic radiation from the conductive coating on the missile case through the support structure and launcher frame to earth, thus providing a ground path for the missile case.

The present invention has been specifically developed for use with a TOW missile manufactured by the assignee of the present invention. However, the present invention is also compatible with Navy shipboard safety requirements and is therefore applicable to many defense missile systems. The present invention also improves operational reliability of the missile with which it is employed by rejecting outside electromagnetic radiation interference and countermeasures.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
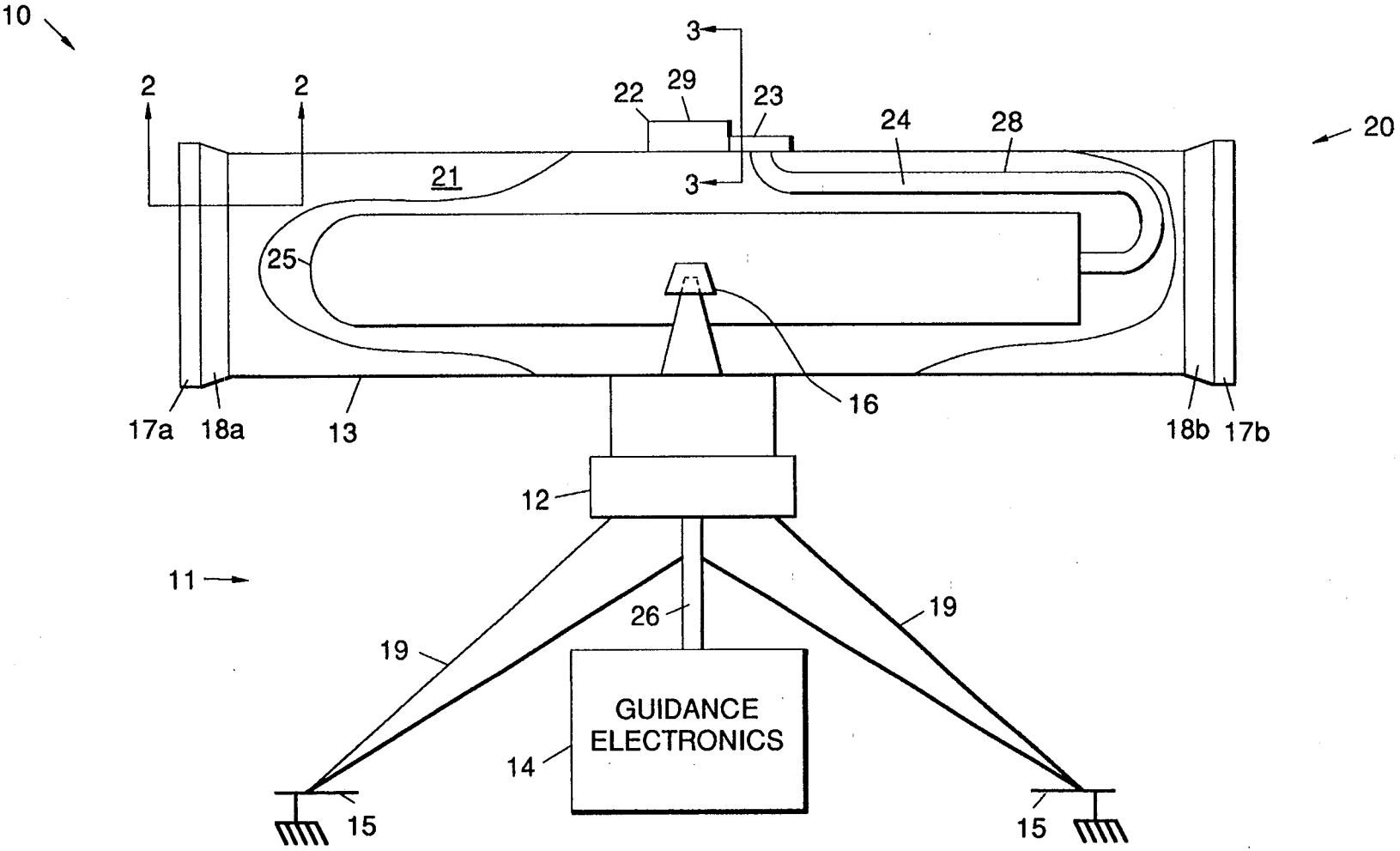
FIG. 1 illustrates an electromagnetic radiation resistant missile and launcher system in accordance with the principles of the present invention.

Referring to FIG. 1, it illustrates an electromagnetic radiation resistant missile and launcher system 10 in accordance with the principles of the present invention. The electromagnetic radiation resistant missile and launcher system 10 comprises a launch system 11 that includes a metal frame 12 having a plurality of supporting structures 19 and feet 15 that support it on the ground or when attached to a vehicle, such as a helicopter, for example. The launcher system 10 also includes guidance electronics 14 that has a shielded electrical cable 26 that couples signals to a missile to control launching of the missile 25.

The launch system 11 supports a missile housing 20 or case 20 that carries the missile 25 therein. Support is provided between the missile housing 20 and the frame 12 of the launch system 11 by means of a plurality of trunnion preforms 16 molded into the case 20 that are coupled to the frame 12 of the launcher system 11. The trunnion preforms 16 couple electromagnetic radiation between a conductive coating 21 on the case 20 and launcher frame 12, thus providing a separate ground path for the missile case 20. The trunnion preforms 16 may be made of composite material comprising conductive particles disposed in an epoxy base.

The missile case 20 comprises a launch tube 13, which has forward and aft end caps 17*a*, 17*b* that attach to opposite ends thereof. Forward and aft preforms 18*a*, 18*b* are molded into the launch tube 13 adjacent the end caps 17*a*, 17*b*. The forward and aft preforms 18*a*, 18*b* may be made of composite material comprising conductive particles disposed in an epoxy base. A flexible holdback seal and seal retainer 22 and an umbilical connector 23 are disposed on the external surface of the launch tube 13. An umbilical cable harness 24 is disposed inside a raceway 28 and is coupled between the umbilical connector 23 and the missile 25.

The launch tube 13 has a conductive paint 21 or coating 21 disposed on the outer surface thereof. A low temperature vapor deposited metallic coating 29 is deposited on the flexible holdback seal and seal retainer 22. The conductive coating 21 electrically couples the launch tube 13 to the launch system 11 by way of the flexible holdback seal and seal retainer 22. This is achieved by means of the vapor deposited metal coating 29 disposed on the flexible holdback seal and seal retainer 22.

The guidance electronics 14 of the launch system 11 is connected by way of the electrical cable 26 to the umbilical connector 23 and thereafter to an umbilical cable harness 24 and raceway 28 that is coupled to the missile 25. The umbilical connector 23 interfaces between wiring in the missile 25 and, the guidance electronics 14 in the launcher system 11. The umbilical cable harness 24 in the raceway 28 is fabricated using dielectric filter line wire 30 (FIG. 3) that attenuates and isolates high frequency electromagnetic radiation from the missile 25.

Figure 2:
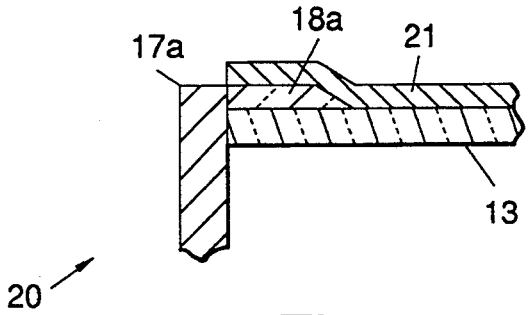
FIG. 2 is a cross sectional view that illustrates details of an end cap portion of the system of FIG. 1.

FIG. 2 is a cross sectional view that illustrates details of the case 20 adjacent the end cap 17*a*. The launch tube 13 is made of nonconductive epoxy material, for example. The launch tube 13 has the composite preform 18*a* affixed to its end that abuts the end cap 17*a*. The conductive paint 21 coats the surface of the launch tube 13 and the composite preform 18*a*. The end cap 17*a* comprises metal or conductive composite material so that electrical coupling is ensured due to capacitive coupling between the composite preform 18*a* and the end cap 17*a*. Electrical coupling does not depend on resistive contact. The conductive paint 21 electrically couples to the conductive composite preform 18*a*. The conductive composite preform 18*a* in turn couples to the conductive end cap 17*a*.

A Faraday shield is formed by the conductive forward and aft end caps 17*a*, 17*b*, which in turn are electrically coupled to launch tube 13 by way of the metal composite preforms 18*a*, 18*b* at each end of the launch tube 13. The interface between the aft end cap 17*b* and the aft preform 18*b* is designed to capacitively couple the launch tube 13 to the aft end cap 17*b*. More specifically, the outer surface of the composite preform 18*a* provides a large conductive surface area that interfaces to the end cap 17*a*. This large surface area creates a capacitor for radio frequency (RF) coupling to the end cap 17*a*, thus providing a compete Faraday shield around the missile 25 disposed in the case 20.

Figure 3:
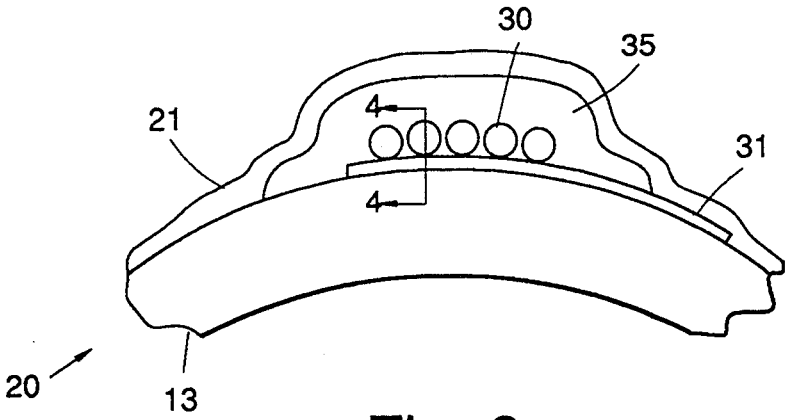
FIG. 3 is a cross sectional view illustrating a connector portion of the system of FIG. 1.

FIG. 3 is a cross sectional view illustrating a portion of the system 10 in the area of the umbilical connector 23. The umbilical connector 23 is comprised of dielectric filter line wire 30 that is pressed against a conductive foil 31 that provides for electrical contact therebetween. The dielectric filter line wire 30 and conductive foil 31 are surrounded by an epoxy raceway 35. A portion of the conductive foil protrudes from the epoxy raceway 35. The conductive foil 31 contacts the outer surface of the launch tube 13 and the conductive paint 21 covers the protruding portion of the conductive foil 31 and makes electrical contact with it. Thus, the harness 24 is coupled to the paint 21 by way of the conductive foil which enhances the ground plane created by the paint 21. The filter line wire harness 24 is installed along the outer surface of the case 20, and is covered with an epoxy raceway 35.

Figure 4:
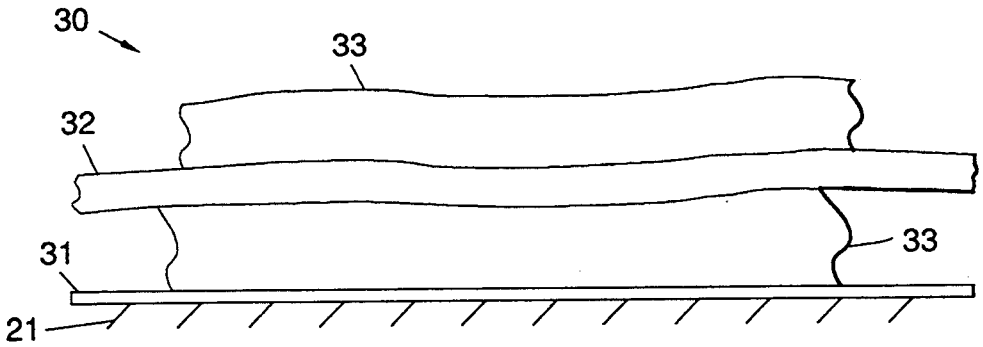
FIG. 4 is a cross sectional view illustrating dielectric filter line wire shown in FIG. 3.

FIG. 4 is a cross sectional view illustrating dielectric filter line wire 30 shown in FIG. 3. The dielectric filter line wire 30 is commercially available and incorporates special insulation 33 that produce high losses to RF signals when the wire 30 is installed along a ground plane, such as is provided by the conductive paint 21. Conductors 32 are surrounded by the insulation 33 which is impregnated with ferrite. The insulation 33 is made of a material that exhibits high dielectric loss at high frequencies. This arrangement produces inductive reactance which attenuates high frequencies. The insulation 33 of the filter line wire 30 becomes a conductor for high frequencies. If the insulation 33 contacts a ground plane 21, RF signals are shorted to the ground plane 21 rather than passing through the wire 30. Low frequency signals are not affected.

The electromagnetic radiation resistant missile case 20 provides a low cost means for providing electromagnetic radiation protection for the guided missile 25 when it is exposed to a hazardous electromagnetic radiation to ordnance environment. The present invention minimizes possible occurrences of missile problems in such an environment due to missile degradation, damage, or premature detonation when it is stored, handled, transported, or deployed.

The present invention provides the protective electrical Faraday shield around the missile 25, electrically isolates and decouples high frequency signals from entering the missile 25 through the wiring coupled thereto, and provides electrical coupling from the case 20 to ground when the missile 25 is attached to the launcher system 11 prior to deployment. The present invention is implemented by using an unconventional combination of technologies, including the use of composite materials for the preforms 18*a*, 18*b* and the trunnion preforms 16, vapor deposition of conductive coatings onto surfaces of the flexible holdback seal and seal retainer 22, high frequency dielectric insulation filter line wire 30 employed in the umbilical cable harness 24, and strategic high frequency capacitive coupling between the aft end cap 17*b* and the launch tube 13 by way of the aft preform 18*b*.

The key to the present invention is in the recoupling, or isolation, of high frequencies in the interface wiring between the missile 25 and the launcher system 11 while at the same time using the missile case 20 to form an independent high frequency Faraday shield around the missile 25. This is in contrast to conventional designs, wherein the launcher system 11 shielding is integrated into the shielding of the missile 25 through sealed mechanical interfaces and shielded interface connector 23.

By attenuating, or isolating, the unwanted high frequency radiation in the umbilical cable harness 24 through the raceway 28 between the missile 25 and the umbilical connector 23 using filter line wire 30, a much simpler and more economical system 10 is provided. While the present invention achieves the same objective as conventional approaches, it provides an independent high frequency electromagnetic radiation shield for the missile 25 that is separate from the launcher system 11. This enables the missile 25 to be isolated by the umbilical cable harness 24 and raceway 28 and independently shielded by the case 20. This virtually eliminates outside high frequency electromagnetic radiation from entering the missile 25. During deployment, when the missile 25 and case 20 are connected to the launcher system 11, the case 20 automatically becomes safely grounded to the launcher system 11 because of its mechanical and electrical coupling to the launcher frame 12.

The electromagnetic radiation shielding of the missile 25 is implemented by applying the conductive paint 21 on the launch tube 13. This forms a major part of the Faraday shield. The coating 21 also covers the umbilical raceway 28, and forms a shield over the umbilical cable harness 24. High frequency electromagnetic radiation signals are isolated from the missile 25 by using dielectric filter line wire 30 insulation in fabricating the umbilical cable harness 24. This eliminates the need for expensive conventional shielded cable and shielded connectors. The dielectric filtering provided by the dielectric filter line wire 30 insulation in the umbilical cable harness 24 short circuits high frequency signals before they reach any internal circuitry of the missile 25. The forward and aft end caps 17*a*, 17*b* are electrically coupled to the coating 21 on the launch tube 13 by using the conductive epoxy/metal composite preform 18*a*, 18*b* that is molded into the case 20 at both ends of the launch tube 13 and is then coated with conductive paint 21. The conductive forward and aft preforms 18*a*, 18*b* capacitively couple high frequency electromagnetic radiation to the metallic end caps 17*a*, 17*b* of the case 20, thus completing the Faraday shield.

In a launch-ready (deployment) configuration, the case 20 electrically couples high frequency electromagnetic radiation to the metal launcher frame 12 through the epoxy/metal composite trunnion preforms 16 that are molded into the case 20. Additional electrical paths ,are provided by the low temperature vapor deposited metallic coating 29 on the flexible holdback seal and seal retainer 22 which directly contact the conductive paint 21. These redundant circuit paths provide high reliability. The frame 12 of the launcher system 11 then provides the direct electrical path that couples the case 20 to ground.

Thus them has been described a new and improved electromagnetic radiation resistant missile and launcher system. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. An electromagnetic radiation resistant missile and launcher system for shielding a missile from incident electromagnetic radiation, said system comprising:
- a missile;
- guidance electronics having an electrical cable for coupling signals to the missile to control guidance and launching thereof;
- a launch system comprising:
  - a conductive launcher frame having a plurality of support structures that provide support therefor;
  - a missile case for carrying the missile therein and which comprises:
    - a launch tube having a conductive coating disposed on the outer surface thereof;
    - a plurality of trunnion preforms molded into the launch tube that comprise conductive composite material and that are supported by the launcher frame to support it when it is on the ground;
    - forward and aft preforms molded into the launch tube adjacent opposite ends thereof that comprise conductive composite material;
    - removable conductive forward and aft end caps that are removably coupled to opposite ends of the launch tube and which are capacitively coupled to the launch tube by means of the forward and aft preform;
    - a flexible holdback seal and seal retainer disposed on an external surface of the launch tube that each have a conductive coating disposed thereon; and
    - an umbilical connector disposed on the external surface of the launch tube;
  - a raceway coupled between the umbilical connector and the missile; and
  - an umbilical cable harness disposed in the raceway and coupled between the umbilical connector and the missile that comprises dielectric filter line wire for attenuating high frequency electromagnetic radiation and isolate the high frequency electromagnetic radiation from the missile.

2. The system of claim 1 wherein a Faraday shield is formed by conductive coatings disposed on the end caps, the flexible holdback seal and seal retainer, and the launch tube, the umbilical connector, the forward and aft preforms, and wherein the trunnion preforms provide for coupling of the electromagnetic radiation from the conductive coating on the missile case through the launcher frame to earth, thus providing a ground path for the missile case.

3. The system of claim 1 wherein the conductive launcher frame comprises metal.

4. The system of claim 1 wherein the conductive coating comprises metallic paint.

5. The system of claim 1 wherein the conductive composite material of the plurality of trunnion preforms comprises conductive particles disposed in an epoxy base.

6. The system of claim 1 wherein the forward and aft preforms comprises conductive particles disposed in an epoxy base.

7. The system of claim 1 wherein the conductive coating on the flexible holdback seal and seal retainer comprises a low temperature vapor deposited conductive coating.

* * * * *